US008568050B2

(12) United States Patent
Pinter

(10) Patent No.: US 8,568,050 B2
(45) Date of Patent: Oct. 29, 2013

(54) DRYWALL TOOL

(76) Inventor: Jonathon Carl Pinter, Rural Hall, NC (US)

( * ) Notice: Subject to any disclaimer, the term of this patent is extended or adjusted under 35 U.S.C. 154(b) by 536 days.

(21) Appl. No.: 12/877,849

(22) Filed: Sep. 8, 2010

(65) Prior Publication Data

US 2012/0057923 A1 Mar. 8, 2012

(51) Int. Cl.
*A47L 13/30* (2006.01)

(52) U.S. Cl.
USPC ..... 401/264; 401/205; 401/206

(58) Field of Classification Search
USPC ..... 401/196, 205, 206, 263, 264
See application file for complete search history.

(56) References Cited

U.S. PATENT DOCUMENTS

| | | | | | |
|---|---|---|---|---|---|
| 3,054,134 | A * | 9/1962 | Meyerhoefer | ..... | 401/206 |
| 4,569,612 | A * | 2/1986 | Schwartzman et al. | ..... | 401/206 |
| 5,082,386 | A * | 1/1992 | Hironaka et al. | ..... | 401/206 |
| 5,411,345 | A * | 5/1995 | Ueji et al. | ..... | 401/206 |
| 5,568,990 | A * | 10/1996 | McAuley | ..... | 401/206 |
| 6,095,705 | A * | 8/2000 | Phillips | ..... | 401/6 |

* cited by examiner

*Primary Examiner* — David Walczak
(74) *Attorney, Agent, or Firm* — Sinorica, LLC

(57) ABSTRACT

An ink application tool that allows users to accurately mark surfaces for cutting without the need for measurements. The ink application tool makes use of an applicator with a uniquely designed dispensing mechanism that allows users to evenly mark surfaces that need to be cut by outlining the object to be fitted into the cutout.

17 Claims, 5 Drawing Sheets

DRYWALL TOOL

FIELD OF THE INVENTION

The present invention relates generally to tool for helping users make accurate cuts on drywall. It is the objective of the present invention to allow users to make accurate cuts on drywall without the need for measurements.

BACKGROUND OF THE INVENTION

Typically, during the installation of drywall, customized cut outs are required to be made to accommodate protruding objects such as power outlets, pipes, switch boxes, and other various fixtures. When making these custom cuts, a great deal of time is taken to make careful measurements and then afterwards to mark these measurements correctly onto the piece of drywall that is to be to be cut. Due to human error, often the measurements and markings fail to be taken and marked accurately. Subsequently, the piece of drywall is cut wrong. Not only must this task be performed again, but valuable time, material, and labor is wasted.

The present invention overcomes such problems by introducing a tool that will eliminate the need to have to make tedious, error prone measurements and markings which lead to performing inaccurate custom cut outs on the piece of drywall. The present invention is a device that allows its users to apply ink onto the edges of the protruding object which the drywall must be cut to accommodate. Once the ink is applied to the protruding edges of the object, the drywall is properly aligned and then pressed against the ink laden edges of the object. A precise image of the object is left on the piece of drywall to be cut out perfectly and accurately.

Not only does this tool cut down the cost of wasted time, material, and labor, but it also speeds up the drywall installation process by eliminating the need to make time consuming measurements. Swift instant accurate drywall cut outs are attained by using this ink instrument rather than the old slow method of measuring. This tool can be used for a variety of jobs, not just for drywall installations. It can also be used when installing vanities, cupboards, indoor paneling, exterior vinyl siding, floor coverings, ceiling tile, or anything that needs a custom cut to accommodate an object.

The tool is multi-purposed and can be used on drywall, vanities, covers, doors, or any other surfaces that require cutouts. The present invention can be used anytime you have a protruding object you have to cut around. Though the present invention is made to be used for aiding in the marking for cut outs, it is not limited to this. For example, the present invention can also be used for placement markings such as hinge placement for a door. To prevent the misalignment of door hinges onto a door frame, the present invention can be used to mark the placements of the hinges. Additionally, the present invention can be used to make the areas on a door frame that require drilling of holes for fastening. The present invention is useful for any application that requires marking for alignment and cutting.

DETAIL DESCRIPTIONS OF THE INVENTION

All illustrations of the drawings are for the purpose of describing selected versions of the present invention and are not intended to limit the scope of the present invention.

The present invention is an ink applicator tool that allows users to outline protruding edges of the objects that need to be cut out of a panel of drywall. The ink used by the invention is an ink that appears on the material that needs to be cut. The present invention comprises of a foam applicator 1, an application dock 2, a bottle 3, and a cap 4. These components come together to form a tool that is able to dispense ink for even application around a protruding object for cutting out.

Figure 1:
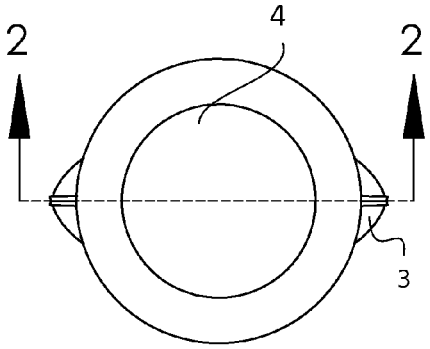
FIG. 1 is a top plan view of the present invention showing a plane upon which a section view is taken and shown in FIG. 2.

In reference to FIG. 1, the bottle 3 is the main body of the present invention. The bottle 3 comprises of a bottle mouth 31, a screw thread 32, a bottle neck 33, a snap-on lip 34, a body 38, recessed areas 35, a wide base 36, and an interior chamber 37. The body 38 of the bottle 3 is a wall that extends vertically connecting to the neck and the wide base 36. On two opposite sides of the body 38 are positioned recessed surfaces. The two recessed surfaces define the recessed areas 35 of the body 38. The recessed areas 35 are inward indentations that make the body 38 of the bottle 3 narrower. However, this narrow characteristic of the body 38 allow for easier handling and squeezing for a user. The user can handle the present invention by the two opposite recessed surfaces. The bottle neck 33 is circular wall that extends upwardly with reducing radius for a funneling type structure. The space within the walls and circular walls defined by the body 38 and the bottle neck 33 is the interior chamber 37 of the present invention. This interior chamber 37 is where the present invention is able to store and dispense ink from for marking of the drywall to make cut outs. At the end of the body 38 opposite of the neck is positioned the wide base 36. The wide base 36 provides the present invention a stable foundation to rest upon and the ability stand up vertically for easy access. The wide base 36 is defined by the bottom surface of the present invention that is not narrowed by the recessed areas 35 and comprises of a larger perimeter than the body 38. At the top of the bottle neck 33 is the bottle mouth 31. The bottle mouth 31 is an opening leading into the interior chamber 37 of the bottle 3.

Figure 2:
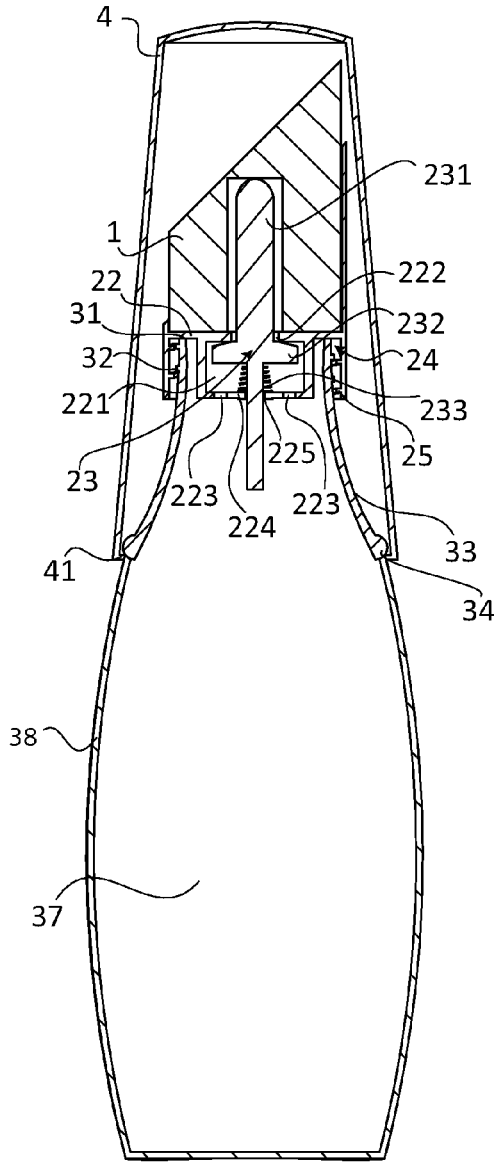
FIG. 2 is a right side view of the present invention.

In reference to FIG. 2, the application dock 2 comprises of an angled applicator mount 21, a barrier 22, a dispenser nub 23, a dock connection port 24, and a dock female thread 25. The application dock 2 is cylindrically shaped with an angled end. The angled applicator mount 21 is a recessed space positioned parallel to the angled end of the application dock 2. The dock connection port 24 is a circular recessed space positioned on the end of the application dock 2 opposite of the angled end. The dock female thread 25 is positioned along the inside circumference of the circular recessed space. The application dock 2 is connected to the bottle 3 by the connection of the dock connection port 24 and the bottle mouth 31. However, the dock connection port 24 is secured and fastened onto the bottom mouth by the dock female thread 25 and the screw thread 32. The dock female thread 25 is positioned on the inside circumference of the circular recessed space. The screw threads 32 are positioned on the peripheral edge of the bottle mouth 31. The elliptical flat surfaced recessed space and the circular recessed space on the application dock 2 are separated by a barrier 22. For the ink from the interior chamber 37 to be dispensed into the angled applicator mount 21 the dispenser nub 23 is utilized to control the release of the ink. The dispenser nub 23 is positioned in the center of the barrier 22. To hold the dispenser nub 23, the barrier 22 comprises of a nub chamber 221, a dispense hole 222, leak holes 223, a spring barrier 224, and a nub track 225. The dispenser nub 23 comprises of a nub head 231, a dispense hole block 232, and a block spring 233. The nub chamber 221 is a circular cavity positioned in the center of the barrier 22. The dispense hole 222 is a hole on the barrier 22 that leads into the nub chamber 221. The dispense hole 222 is where the ink from the interior chamber 37 is able to exit the present invention and onto the foam applicator 1. The leak holes 223 are holes positioned on the barrier 22 on the side adjacent to the interior chamber 37. These leak holes 223 allows the ink to flow from the interior chamber 37 into the nub chamber 221 and out of the dispense hole 222. The areas of the barrier 22 between the nub chamber 221 and the interior chamber 37 define the spring barrier 224. The nub head 231 is the part of the dispenser nub 23 that protrudes out of the nub chamber 221 from the dispense hole 222. The nub head 231 protrudes out of the dispense hole 222 and extends out of the angled applicator mount 21. The dispense hole block 232 of the nub is a protrusion around the circumference of the dispenser nub 23 that is positioned within the nub chamber 221. The block spring 233 is positioned between the spring barrier 224 and the dispense hole block 232 in a concentric relationship to the dispenser nub 23. The block spring 233 acts to push the dispense hole block 232 up against and seal the dispense hole 222. The dispense hole block 232 is sized to be have a larger radius than the dispense hole 222. The dispenser nub 23 is also positioned along the nub track 225. The nub track 225 is positioned on the spring barrier 224 to ensure that the dispenser nub 23 does not become side tracked and jammed inside the nub chamber 221. To release the ink from the interior chamber 37, the user can press to depress the nub head 231 which separates the dispense hole block 232 from the dispense hole 222. This allows the ink to flow from the interior chamber 37 into the nub chamber 221 and out of the dispense hole 222.

As shown in FIG. 2, the foam applicator 1 is an elliptically shaped with a circular base piece of foam with a flat surface due to the angled opening of the angled applicator mount 21. The foam applicator 1 is positioned and held in the angled applicator mount 21. The circular base portion of the foam applicator 1 is pushed down to contact the barrier while the elliptically shaped portion is protruding from the angled applicator mount. The foam applicator 1 is made from an absorbent type of foam and can easily retain the ink dispensed from the interior chamber 37. By applying pressure with the present invention onto the foam applicator 1 onto surfaces that require marking, the foam applicator 1 is able to release a controlled amount of ink.

Figure 3:
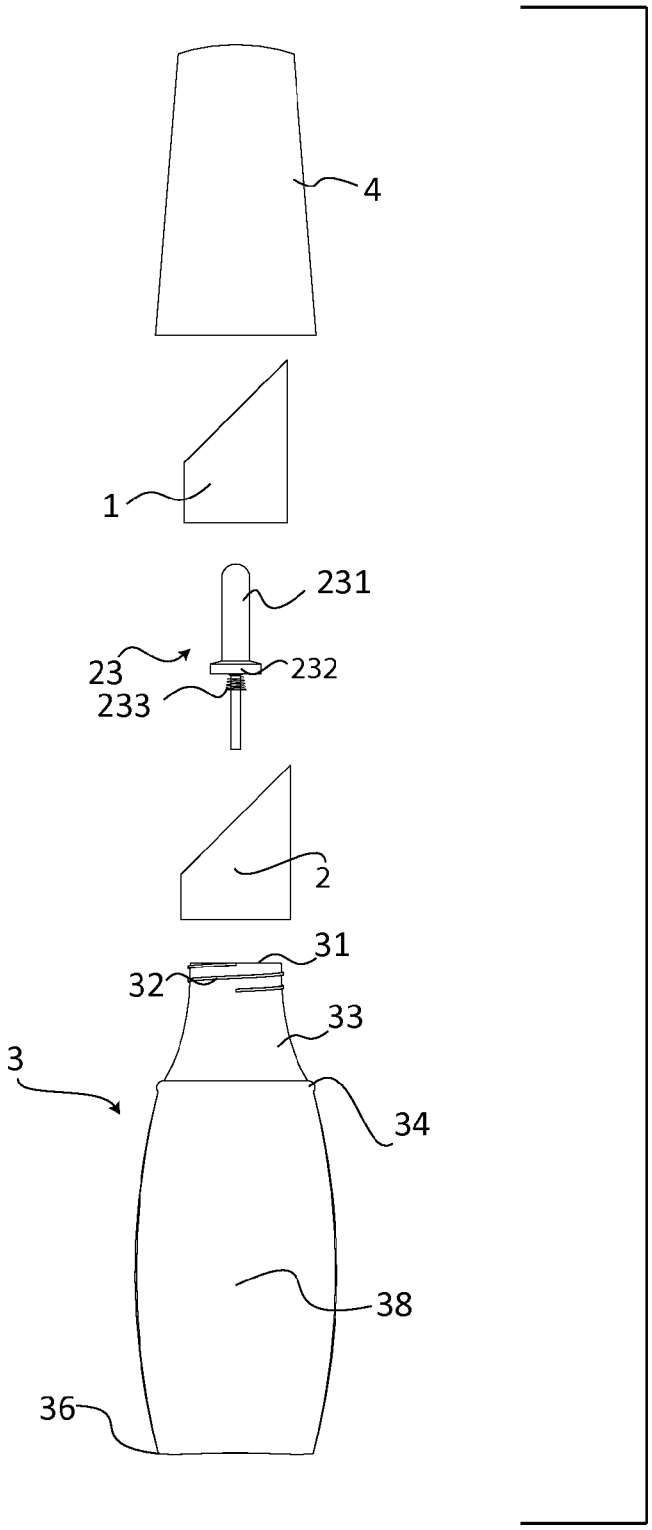
FIG. 3 is an explosion view of the present invention.
Figure 4:
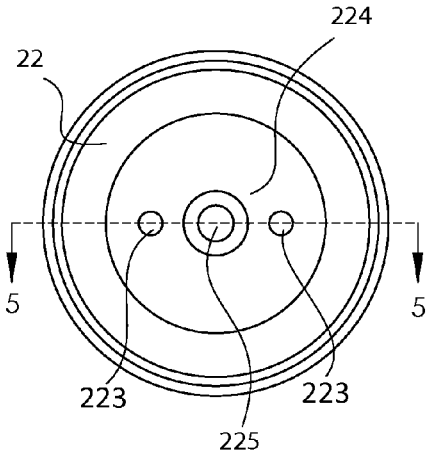
FIG. 4 is a bottom plan view of the application dock showing a plane upon which a section view is taken and shown in FIG. 5.
Figure 5:
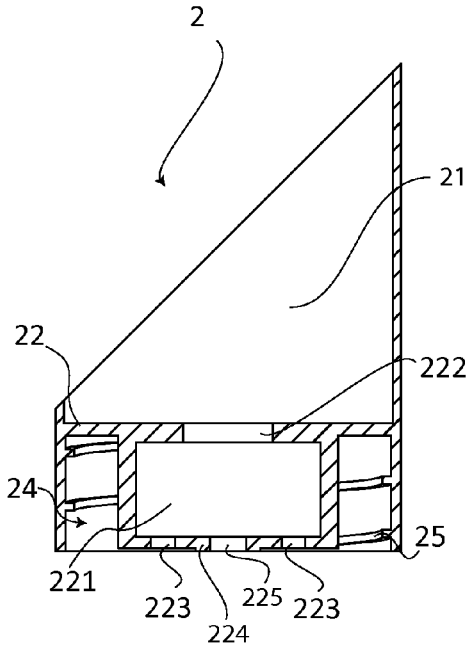
FIG. 5 is a right side view of the application dock of the present invention.
Figure 6:
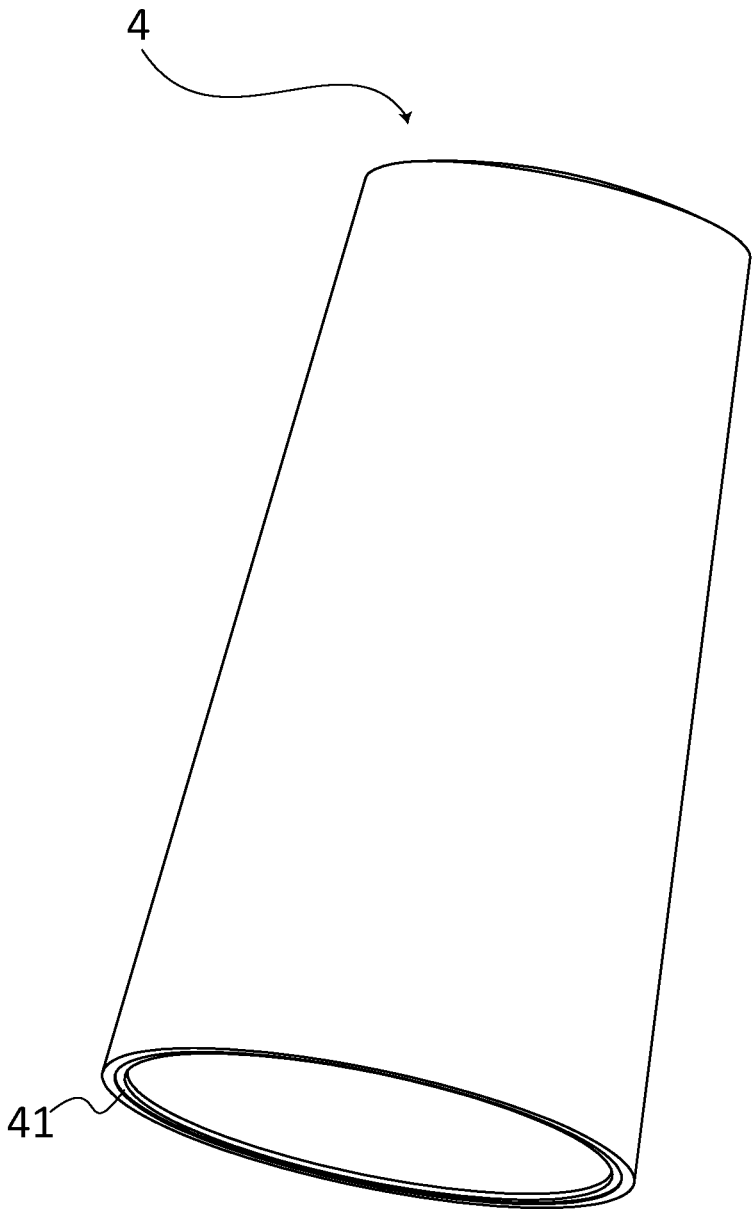
FIG. 6 shows the cap of the present invention.
Figure 7:
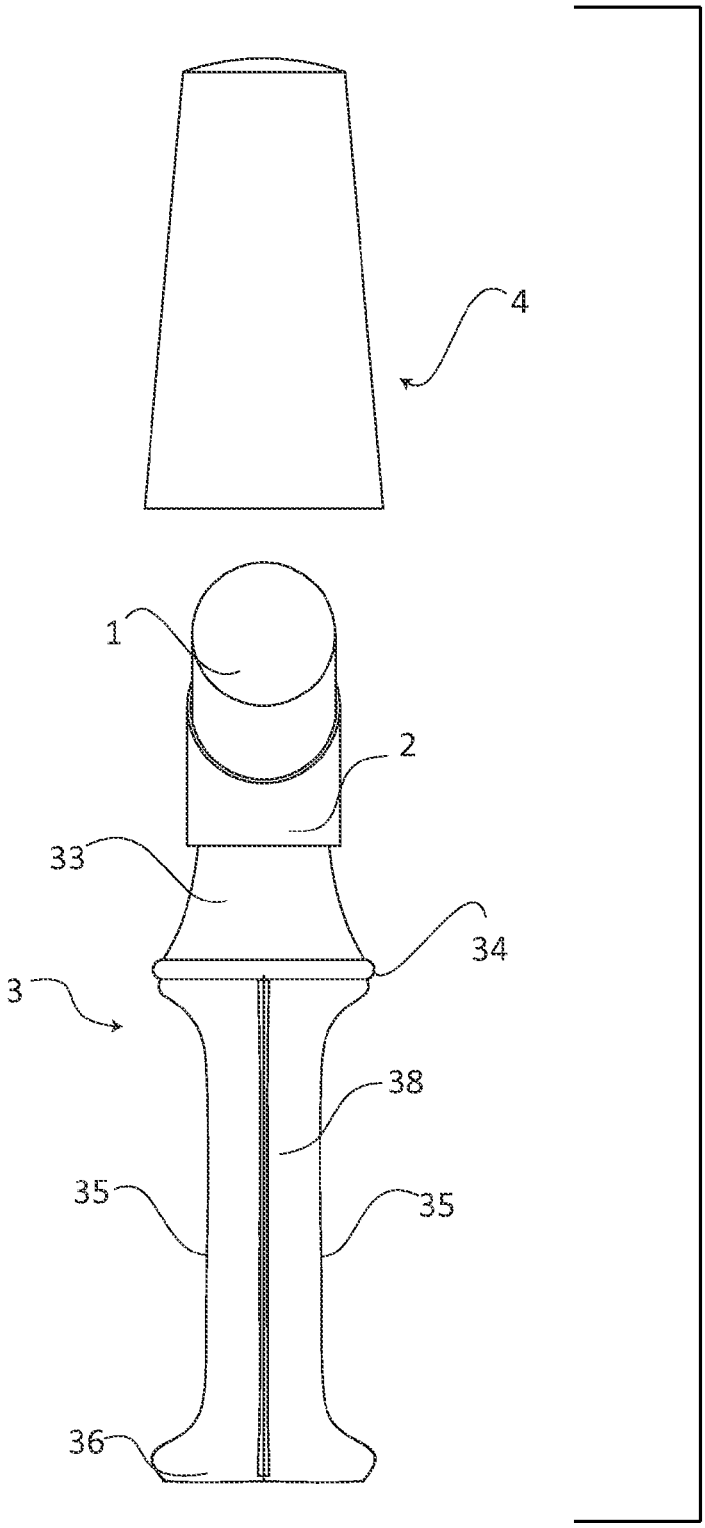
FIG. 7 is a front elevational view of the present invention with the cap separated.

In reference to FIG. 3, the cap 4 comprises of a snap-on bump 41. The cap 4 is an enveloping enclosure that is attachable to and detachable from the bottle 3. The cap 4 is used to envelope and encloses the application dock 2 to prevent the drying of ink and clogging of the dispense hole 222. The snap-on bump 41 is an inward protrusion along the inner cap circumference of the cap 4. The cap 4 is connected to the bottle 3 over the application dock 2 by snapping the snap-on bump 41 over the snap-on lip 34. The snap-on lip 34 is a round protrusion positioned on the bottle 3 circumference between the body 38 and the bottle neck 33. The positioning of the snap-lip allows the cap 4 to enclose the bottle neck 33, the application dock 2, and the foam applicator 1 entirely.

Although the invention has been explained in relation to its preferred embodiment, it is to be understood that many other possible modifications and variations can be made without departing from the spirit and scope of the invention as hereinafter claimed.

What is claimed is:

1. A dry wall tool comprises, a foam applicator;

an application dock;

a cap;

a bottle;

the application dock comprises of an angled applicator mount, a barrier, a dispenser nub, a dock connection port, and a dock female thread;

the barrier comprises of a nub chamber, a dispense hole, leak holes, a spring barrier, and a nub track;

the dispenser nub comprises of a nub head, a dispense hole block and a block spring;

the bottle comprises of a bottle mouth, a screw thread, a bottle neck, a snap-on lip, a body, recessed areas, a wide base, and an interior chamber;

the body being a wall extending vertically to the neck and the wide base;

the body having two opposite recessed surfaces defining the recessed areas;

the two opposite recessed surfaces extended inwardly along a vertical axis of the body;

the bottle neck being a funneling wall extending upwardly towards the bottle mouth;

the interior chamber being a space within the wall and the funneling wall defined by the body and the bottle neck, respectively;

the bottle mouth being positioned on the bottle neck;

the bottle mouth being an opening leading into the interior chamber of the bottle;

the application dock being cylindrically shaped with an angled end;

the angled applicator mount being an elliptical flat surfaced recessed space positioned on and positioned in a parallel relationship to the angled end;

the dock connection port being a circular recessed space positioned on the application dock;

the dock female thread being positioned on an inside circumference of the circular recessed space; and the barrier being positioned between the elliptical flat surfaced recessed space and the circular recessed space.

2. The dry wall tool as claimed in claim 1 comprises, the nub chamber being a cavity positioned within the barrier and arranged in concentric relationship with barrier;

the dispense hole connecting the nub chamber with the angled applicator mount;

the leak holes connecting the nub chamber with the interior chamber;

the spring barrier being positioned on the barrier adjacent to the interior chamber and adjacent the leak holes;

the nub track being positioned through the spring barrier;

the nub head protruding from the nub chamber through the dispense hole and out of the angled applicator mount;

the dispense hole block protruding in concentric relationship with the nub and positioned in the nub chamber;

the nub being arranged in concentric relationship to the nub track; and the block spring being positioned between the spring barrier and the dispense hole block in concentric relationship to the nub.

3. The dry wall tool as claimed in claim 1 comprises,
the snap-on lip being a round protrusion positioned on a bottle circumference between the body and the bottle neck.
4. The dry wall tool as claimed in claim 1 comprises,
the foam applicator being elliptically shaped with a circular base and inserted into the angled applicator mount.
5. The dry wall tool as claimed in claim 1 comprises,
the screw thread being positioned on a peripheral edge of the bottle mouth.
6. The dry wall tool as claimed in claim 1 comprises,
the wide base being a large platform connected to the body.
7. The dry wall tool as claimed in claim 1 comprises,
the application dock being secured onto the bottle by the dock female thread and the screw threads.
8. The dry wall tool as claimed in claim 1 comprises,
the cap having a snap-on bump;
the snap-on bump being an inward protrusion along an inner cap circumference of the cap;
the cap being connected to the bottled by connection of the snap-on bump with the snap-on lip; and
the cap enclosing the neck, the application dock, and the foam applicator.
9. A dry wall tool comprises,
a foam applicator;
an application dock;
a cap;
a bottle;
the application dock comprises of an angled applicator mount, a barrier, a dispenser nub, a dock connection port, and a dock female thread;
the barrier comprises of a nub chamber, a dispense hole, leak holes, a spring barrier, and a nub track;
the dispenser nub comprises of a nub head, a dispense hole block and a block spring;
the bottle comprises of a bottle mouth, screw threads, a bottle neck, a snap-on lip, a body, recessed areas, a wide base, and an interior chamber;
the body being a wall extending vertically to the neck and the wide base;
the body having two opposite recessed surfaces defining the recessed areas;
the two opposite recessed surfaces extended inwardly along a vertical axis of the body;
the bottle neck being a funneling wall extending upwardly towards the bottle mouth;
the interior chamber being a space within the wall and the funneling wall defined by the body and the bottle neck, respectively;
the bottle mouth being positioned on the bottle neck;
the bottle mouth being an opening leading into the interior chamber of the bottle;
the snap-on lip being a round protrusion positioned on a bottle circumference between the body and the bottle neck;
the application dock being cylindrically shaped with an angled end;
the angled applicator mount being an elliptical flat surfaced recessed space positioned on and positioned in a parallel relationship to the angled end;
the dock connection port being a circular recessed space positioned on the application dock;
the dock female thread being positioned on an inside circumference of the circular recessed space;
the barrier being positioned between the elliptical flat surfaced recessed space and the circular recessed space; and
the foam applicator being elliptically shaped with a circular base and inserted into the angled applicator mount.
10. The dry wall tool as claimed in claim 9 comprises,
the nub chamber being a cavity positioned within the barrier and arranged in concentric relationship with barrier;
the dispense hole connecting the nub chamber with the angled applicator mount;
the leak holes connecting the nub chamber with the interior chamber;
the spring barrier being positioned on the barrier adjacent to the interior chamber and adjacent the leak holes;
the nub track being positioned through the spring barrier;
the nub head protruding from the nub chamber through the dispense hole and out of the angled applicator mount;
the dispense hole block protruding in concentric relationship with the nub and positioned in the nub chamber;
the nub being arranged in concentric relationship to the nub track; and
the block spring being positioned between the spring barrier and the dispense hole block in concentric relationship to the nub.
11. The dry wall tool as claimed in claim 9 comprises,
the screw thread being positioned on a peripheral edge of the bottle mouth; and
the application dock being secured onto the bottle by the dock female thread and the screw threads.
12. The dry wall tool as claimed in claim 9 comprises,
the wide base being a large platform connected to the body.
13. The dry wall tool as claimed in claim 9 comprises,
the cap having a snap-on bump;
the snap-on bump being an inward protrusion along an inner cap circumference of the cap;
the cap being connected to the bottled by connection of the snap-on bump with the snap-on lip; and
the cap enclosing the neck, the application dock, and the foam applicator.
14. A dry wall tool comprises,
a foam applicator;
an application dock;
a cap;
a bottle;
the application dock comprises of an angled applicator mount, a barrier, a dispenser nub, a dock connection port, and a dock female thread;
the barrier comprises of a nub chamber, a dispense hole, leak holes, a spring barrier, and a nub track;
the dispenser nub comprises of a nub head, a dispense hole block and a block spring;
the bottle comprises of a bottle mouth, screw threads, a bottle neck, a snap-on lip, a body, recessed areas, a wide base, and an interior chamber;
the body being a wall extending vertically to the neck and the wide base;
the body having two opposite recessed surfaces defining the recessed areas;
the two opposite recessed surfaces extended inwardly along a vertical axis of the body;
the bottle neck being a funneling wall extending upwardly towards the bottle mouth;
the interior chamber being a space within the wall and the funneling wall defined by the body and the bottle neck, respectively;
the bottle mouth being positioned on the bottle neck;
the bottle mouth being an opening leading into the interior chamber of the bottle;

the snap-on lip being a round protrusion positioned on a bottle circumference between the body and the bottle neck;

the application dock being cylindrically shaped with an angled end;

the angled applicator mount being an elliptical flat surfaced recessed space positioned on and positioned in a parallel relationship to the angled end;

the dock connection port being a circular recessed space positioned on the application dock;

the dock female thread being positioned on an inside circumference of the circular recessed space;

the barrier being positioned between the elliptical flat surfaced recessed space and the circular recessed space;

the foam applicator being elliptically shaped with a circular base and inserted into the angled applicator mount; and the nub chamber being a cavity positioned within the barrier and arranged in concentric relationship with barrier.

15. The dry wall tool as claimed in claim 14 comprises, the dispense hole connecting the nub chamber with the angled applicator mount;

the leak holes connecting the nub chamber with the interior chamber;

the spring barrier being positioned on the barrier adjacent to the interior chamber and adjacent the leak holes;

the nub track being positioned through the spring barrier;

the nub head protruding from the nub chamber through the dispense hole and out of the angled applicator mount;

the dispense hole block protruding in concentric relationship with the nub and positioned in the nub chamber;

the nub being arranged in concentric relationship to the nub track; and the block spring being positioned between the spring barrier and the dispense hole block in concentric relationship to the nub.

16. The dry wall tool as claimed in claim 14 comprises, the screw thread being positioned on a peripheral edge of the bottle mouth; and the application dock being secured onto the bottle by the dock female thread and the screw threads.

17. The dry wall tool as claimed in claim 14 comprises, the wide base being a large platform connected to the body;

the cap having a snap-on bump;

the snap-on bump being an inward protrusion along an inner cap circumference of the cap;

the cap being connected to the bottled by connection of the snap-on bump with the snap-on lip; and the cap enclosing the neck, the application dock, and the foam applicator.

* * * * *